US009385414B2

(12) United States Patent
Lee

(10) Patent No.: US 9,385,414 B2
(45) Date of Patent: Jul. 5, 2016

(54) MALE CONNECTOR ASSEMBLY WITH ANTENNA

(71) Applicant: Owitek Technology Ltd., Taoyuan County (TW)

(72) Inventor: Chun-Heng Lee, Taoyuan County (TW)

( * ) Notice: Subject to any disclaimer, the term of this patent is extended or adjusted under 35 U.S.C. 154(b) by 118 days.

(21) Appl. No.: 14/290,774

(22) Filed: May 29, 2014

(65) Prior Publication Data

US 2014/0377993 A1 Dec. 25, 2014

(30) Foreign Application Priority Data

Jun. 20, 2013 (TW) ..... 102122040 A

(51) Int. Cl.
*H01R 13/66* (2006.01)
*H01Q 1/22* (2006.01)
*H01Q 7/00* (2006.01)

(52) U.S. Cl.
CPC ..... *H01Q 1/22* (2013.01); *H01Q 1/2258* (2013.01); *H01Q 1/2275* (2013.01); *H01Q 7/00* (2013.01); *H01R 13/6633* (2013.01); *H01R 2201/02* (2013.01); *H01R 2201/06* (2013.01)

(58) Field of Classification Search
CPC ..... H01Q 1/22; H01Q 1/2258; H01Q 1/2275; H01Q 7/00; H01R 2201/06; H01R 2201/02; H01R 13/6633; H04B 5/00
USPC ..... 439/620.01
See application file for complete search history.

(56) References Cited

U.S. PATENT DOCUMENTS 6,612,874 B1 * 9/2003 Stout ..... H01R 35/00 439/11
6,975,274 B2 * 12/2005 Sanchez ..... H01Q 1/08 343/702
7,918,682 B2 * 4/2011 Hirai ..... H01Q 1/1278 439/374

* cited by examiner

*Primary Examiner* — Edwin A. Leon
(74) *Attorney, Agent, or Firm* — Chun-Ming Shih; HDLS IPR Services

(57) ABSTRACT

A male connector assembly is plugged into a female connector. The male connector assembly includes a male-head connector and an antenna. The male-head connector includes an electrical connection part and a covering body. The covering body is arranged at a first side of the electrical connection part. The antenna is arranged inside the covering body. The male connector assembly is connected to the female connector, and then the female connector transmits a wireless signal to the antenna. The antenna transmits a back-pass signal to the female connector after the antenna receives the wireless signal. Data is transmitted between the male connector assembly and the female connector when the back-pass signal is verified correctly by an electronic product electrically connected to the female connector.

11 Claims, 5 Drawing Sheets

MALE CONNECTOR ASSEMBLY WITH ANTENNA

BACKGROUND OF THE INVENTION

1. Field of the Invention

The present invention relates to a connector, and especially relates to a male connector assembly with an antenna for receiving and transmitting signals.

2. Description of the Related Art

Currently, a computer can store, backup or download data through the Internet. Besides, the computer (or server) can be connected to an external disk drive through a cable line to store, backup or download data as well. Moreover, a flash drive can be plugged into a connector of the computer, so that the data stored in the flash drive can be transmitted to the computer, or the data stored in the computer can be transmitted to the flash drive. It is easy for a user to download, backup or store data from the computer to the disk drive or the flash drive. Therefore, important data will be stolen easily. Viruses can be transmitted to the computer to break data stored in the computer. Or the computer is down due to viruses. In recent years, technology is progressing every day. To prevent the data from being stolen, passwords or keys will be required for identifying to have access to the data stored in the computer. A column for inputting the password will be displayed on a monitor of the computer when the computer detects that an external apparatus is connected to the computer (namely, when the disk drive is connected to the connector of the computer through the cable line or the flash drive is plugged into the connector of the computer to have access to downloading the data stored in the computer or transmitting data to the computer). The user does not have access to the data stored in the computer or transmitting data to the computer if the computer judges that the password inputted by the user is incorrect. The user has access to the data stored in the computer or transmitting data to the computer if the computer judges that the password inputted by the user is correct.

Although the password identifying method mentioned above may prevent the data from being stolen or prevent the computer from viruses, the user may forget the password or a hacker may crack the password. Therefore, the password identifying method mentioned above is still inconvenient.

SUMMARY OF THE INVENTION

In order to solve the above-mentioned problems, an object of the present invention is to provide a male connector assembly which comprises a male-head connector and an antenna. An antenna unit of a female connector transmits a wireless signal to the antenna of the male connector assembly when the male-head connector is plugged into the female connector. The antenna of the male connector assembly transmits a back-pass signal (an authentication code or a key) to the antenna unit of the female connector after the antenna of the male connector assembly receives the wireless signal transmitted from the antenna unit of the female connector. For security reason, data can be transmitted between the male connector assembly and the female connector only if the authentication code or the key is verified by an electronic product electrically connected to the female connector.

In order to achieve the object of the present invention mentioned above, the male connector assembly of the present invention is connected to a female connector. The male connector assembly comprises a male-head connector and an antenna. The male-head connector comprises an electrical connection part and a covering body. The covering body is arranged at a first side of the electrical connection part. The antenna is arranged inside the covering body. Moreover, the male connector assembly is connected to the female connector, and then the female connector transmits a wireless signal to the antenna. The antenna transmits a back-pass signal to the female connector after the antenna receives the wireless signal. Data is transmitted between the male connector assembly and the female connector assembly when the back-pass signal is verified correctly by an electronic product electrically connected to the female connector.

Moreover, the electrical connection part is a universal serial bus (USB) connector, a mini USB connector, a micro USB connector, a high definition multimedia interface (HDMI) connector, a displayport connector, an RJ-45 connector or a 3.5 millimeter earphone probe. The covering body is made of plastic or rubber. The covering body comprises an absorber. The absorber is made of ferrite or steel with high magnetic permeability. The antenna is made of metal conductor or low temperature co-fired ceramic (LTCC). The antenna is reeled and is embed in a front end of the covering body and is arranged at the first side of the electrical connection part. The male connector assembly further comprises a conductive pin extended from the antenna. The conductive pin is covered by the covering body. The male connector assembly further comprises a lead wire. A plurality of core wires of the lead wire are electrically connected to a plurality of conductive terminals of the electrical connection part and the conductive pin to form a cable line carrying signals after one side of the lead wire is through the covering body. The female connector comprises an antenna unit.

In order to achieve the object of the present invention mentioned above, the male connector assembly of the present invention is connected to a female connector. The male connector assembly comprises a male-head connector, a circuit board, a casing and an antenna. The male-head connector comprises an electrical connection part and a covering body. The covering body is arranged at a first side of the electrical connection part. The circuit board is electrically connected to the electrical connection part. The casing packs the circuit board and one part of the electrical connection part. The antenna is arranged inside the covering body and is electrically connected to the circuit board. Moreover, the male connector assembly is connected to the female connector, and then the female connector transmits a wireless signal to the antenna. The antenna transmits a back-pass signal to the female connector after the antenna receives the wireless signal. Data is transmitted between the male connector assembly and the female connector when the back-pass signal is verified correctly an electronic product electrically connected to by the female connector.

Moreover, the electrical connection part is a universal serial bus (USB) connector, a mini USB connector, a micro USB connector, a high definition multimedia interface (HDMI) connector, a displayport connector, an RJ-45 connector or a 3.5 millimeter earphone probe. The casing is made of plastic or rubber. The casing comprises an absorber. The absorber is made of ferrite or steel with high magnetic permeability. The antenna is made of metal conductor or low temperature co-fired ceramic (LTCC). The antenna is reeled and is embed in a front end of the casing and is arranged at the first side of the electrical connection part. The male connector assembly further comprises a conductive pin extended from the antenna. The conductive pin is covered by the casing and is electrically connected to the circuit board. The female connector comprises an antenna unit.

DETAILED DESCRIPTION OF THE INVENTION

Figure 1:
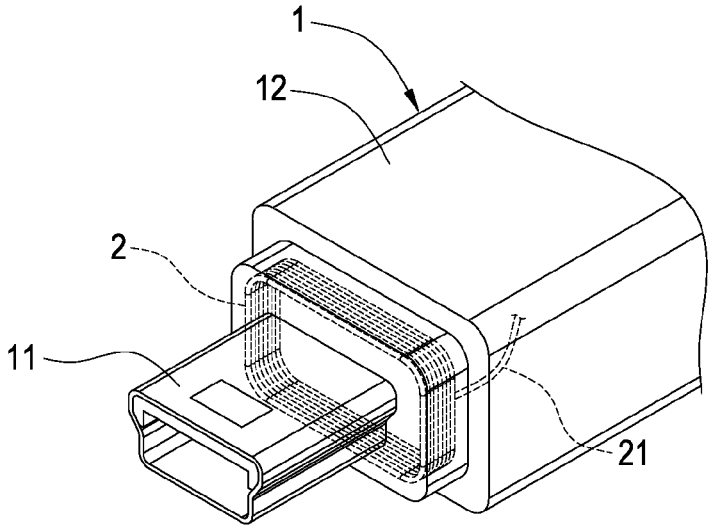
FIG. 1 shows a perspective view of a part of the male connector assembly of the present invention.

FIG. 1 shows a perspective view of a part of the male connector assembly of the present invention. The male connector assembly of the present invention comprises a male-head connector 1 and an antenna 2.

The male-head connector 1 comprises an electrical connection part 11 and a covering body 12. The covering body 12 is arranged at a first side of the electrical connection part 11. The covering body 12 is made of plastic, rubber or absorber which helps with transmitting radio waves, such as ferrite or steel with high magnetic permeability. Moreover, the covering body 12 is made of metal with low coercivity, low magnetic hysteresis loss, high magnetic permeability and high resistance. Speaking to magnetic permeability μr, materials with above 102×10−6 H/m can be permeable materials. Speaking to materials, a typical alloy, such as the transition metal metalloid alloy composed of 80% of transition metal (conventional iron, cobalt, and nickel etc.) and 20% of metalloid (boron, carbon, silicon, phosphor or aluminum) can be permeable materials. In FIG. 1, the electrical connection part 11 is a universal serial bus (USB) connector, a mini USB connector, a micro USB connector, a high definition multimedia interface (HDMI) connector, a displayport connector, an RJ-45 connector or a 3.5 millimeter earphone probe.

The antenna 2 is made of metal conductor (such as metal wire) or low temperature co-fired ceramic (LTCC). The antenna 2 is reeled and is embed in a front end of the covering body 12 and is arranged at the first side of the electrical connection part 11. The male connector assembly further comprises a conductive pin 21 extended from the antenna 2. The conductive pin 21 is covered by the covering body 12.

Figure 2:
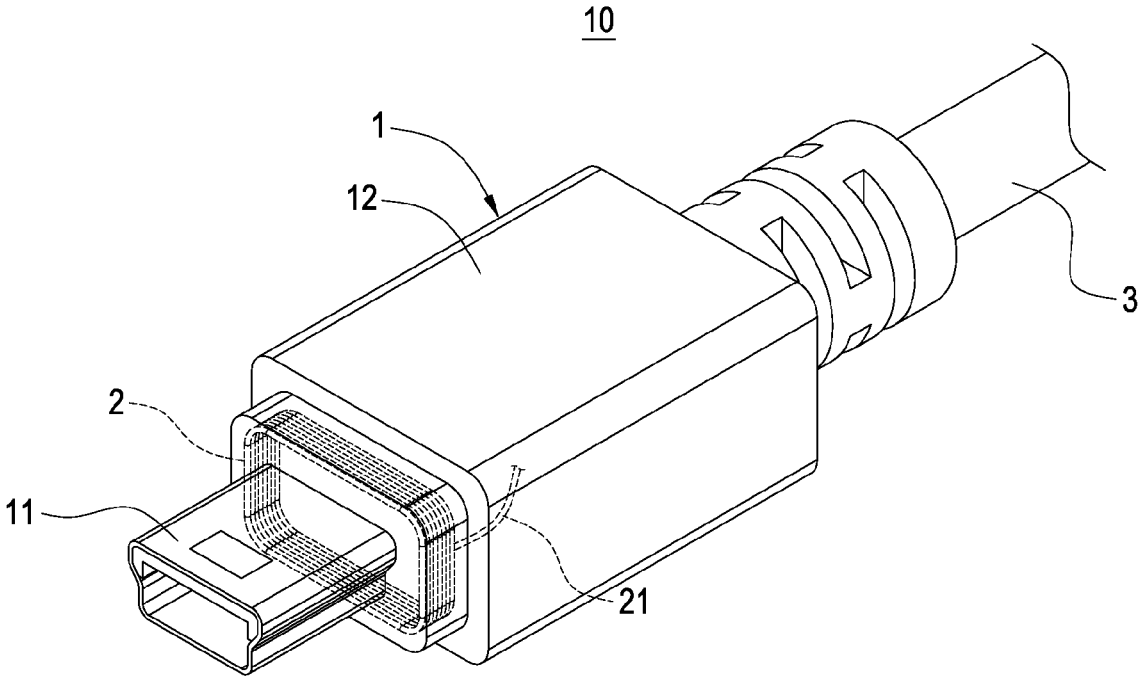
FIG. 2 shows a perspective view of the male connector assembly (cable line) of the present invention.

FIG. 2 shows a perspective view of the male connector assembly (cable line) of the present invention. The male connector assembly further comprises a lead wire 3. The lead wire 3 is connected to the male-head connector 1. A plurality of core wires (not shown in FIG. 2) of the lead wire 3 are electrically connected to a plurality of conductive terminals (not shown in FIG. 2) of the electrical connection part 11 and the conductive pin 21 to form a cable line 10 carrying signals after one side of the lead wire 3 is through the covering body 21.

Figure 3:
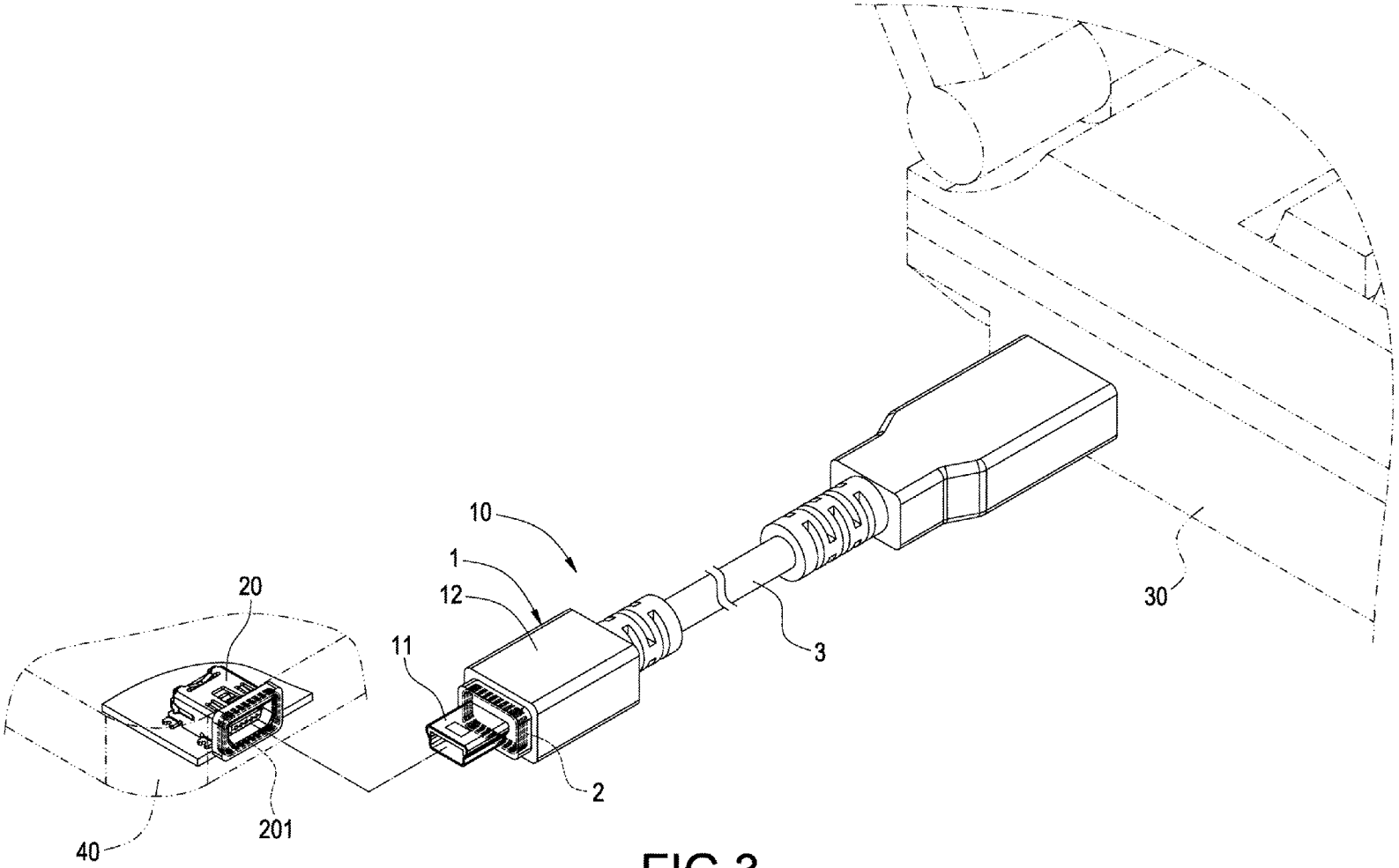
FIG. 3 shows a schematic diagram showing that the cable line of the present invention is electrically connected to the female connector.
Figure 4:
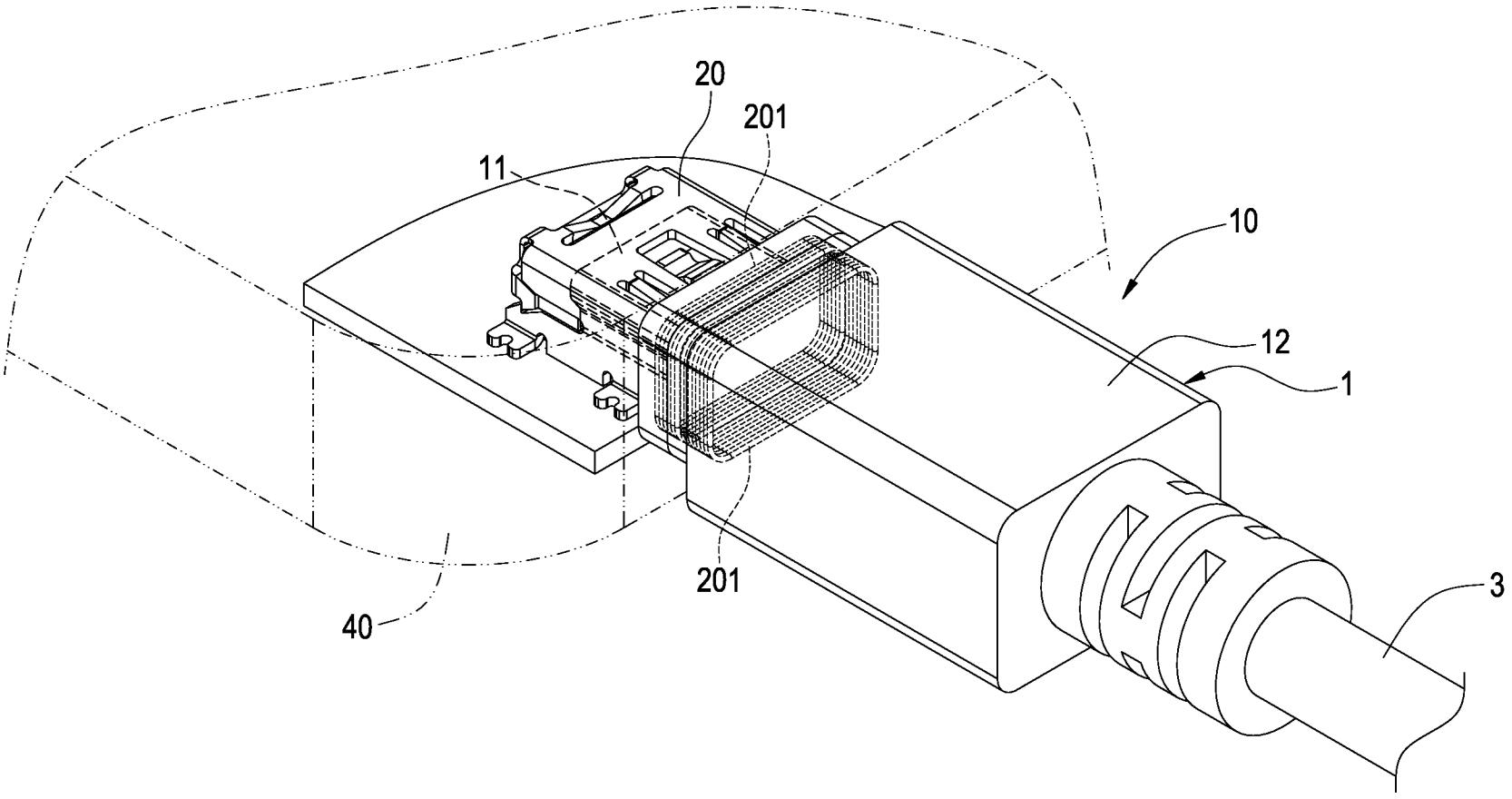
FIG. 4 shows a perspective view showing that the male connector assembly is connected to the female connector.

FIG. 3 shows a schematic diagram showing that the cable line of the present invention is electrically connected to the female connector. FIG. 4 shows a perspective view showing that the male connector assembly is connected to the female connector. The male-head connector 1 is plugged into a female connector 20 which comprises an antenna unit 201 for transmitting data. An electronic product 40 transmits a signal to the antenna 2 through the antenna unit 201. The signal is transmitted through the cable line 10 to an electronic apparatus 30 for processing. An authentication code (namely, a key) is transmitted from the electronic apparatus 30 through the cable line 10 to the antenna 2 for emitting, or the authentication code is transmitted from a chip (for example, an electronic tag) which is arranged in the covering body 12 to the antenna 2 for emitting. Then, the antenna unit 201 receives the authentication code. The authentication code will be processed and verified by the electronic product 40. Data in the electronic product 40 can be transmitted through the cable line 10 to the electronic apparatus 30 for being executed or stored if the authentication code is correct. Or data in the electronic apparatus 30 can be transmitted to the electronic product 40 for being executed or stored. Therefore, the security of data storage and backup is improved.

The antenna 2 can be used as an external antenna if the male-head connector 1 is not plugged into the female connector 20. Therefore, the electronic apparatus 30 can transmit wireless signals, receive wireless signals or connect to the Internet.

Figure 5:
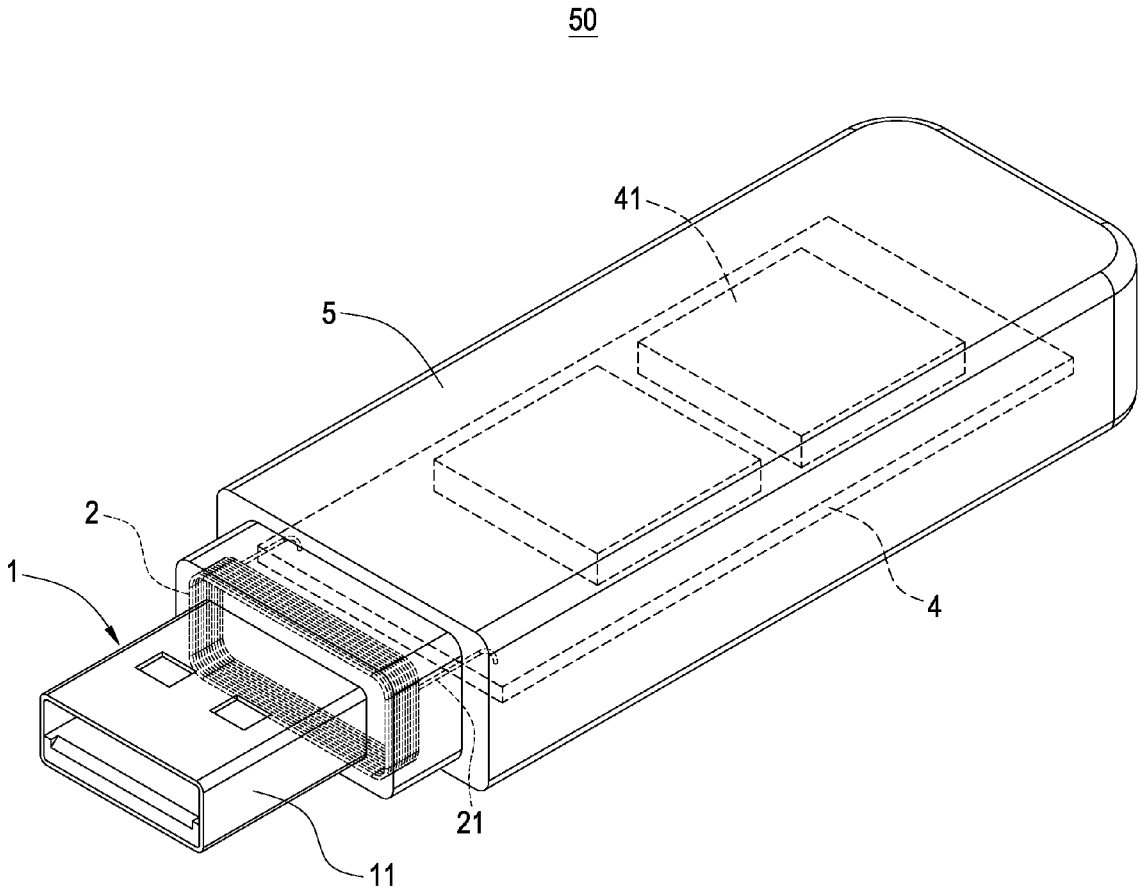
FIG. 5 shows a perspective view of another embodiment of the present invention.
Figure 6:
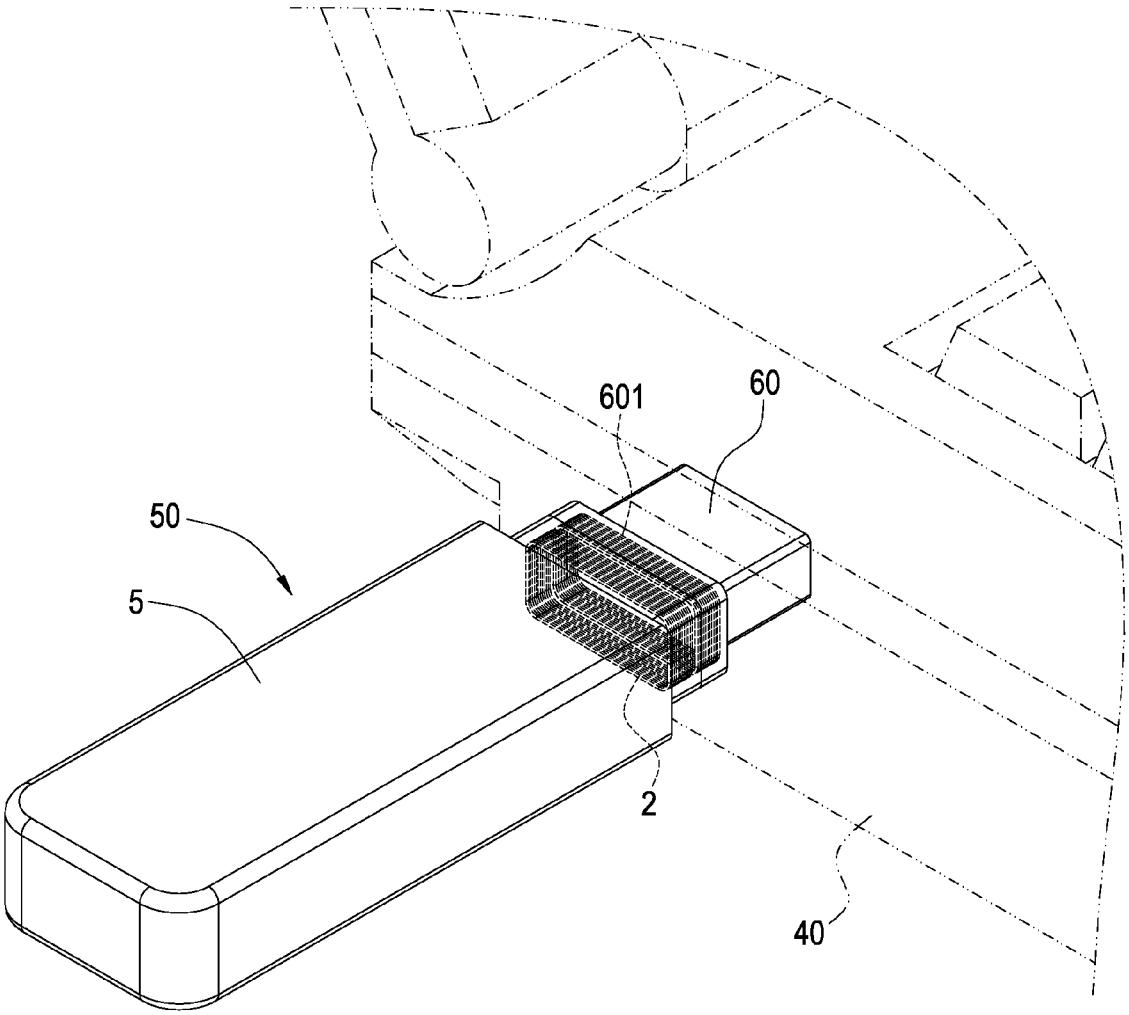
FIG. 6 shows a diagram of an application of FIG. 5.

FIG. 5 shows a perspective view of another embodiment of the present invention. FIG. 6 shows a diagram of an application of FIG. 5. The male connector assembly 1 further comprises a circuit board 4 electrically connected to the electrical connection part 11. The male connector assembly 1 further comprises a casing 5 which packs the circuit board 4 and one part of the electrical connection part 11 to be a flash drive 50. In FIG. 5 and FIG. 6, the casing 5 is made of plastic, rubber or absorber which helps with transmitting radio waves, such as ferrite or steel with high magnetic permeability. Moreover, the casing 5 is made of metal with low coercivity, low magnetic hysteresis loss, high magnetic permeability and high resistance. Speaking to magnetic permeability μr, materials with above 102×10−6 H/m can be permeable materials. Speaking to materials, a typical alloy, such as the transition metal metalloid alloy composed of 80% of transition metal (conventional iron, cobalt, and nickel etc.) and 20% of metalloid (boron, carbon, silicon, phosphor or aluminum) can be permeable materials. In FIG. 5 and FIG. 6, the electrical connection part 11 is a universal serial bus (USB) connector, a mini USB connector, a micro USB connector, a high definition multimedia interface (HDMI) connector, a displayport connector, an RJ-45 connector or a 3.5 millimeter earphone probe.

The antenna 2 is made of metal conductor (such as metal wire) or low temperature co-fired ceramic (LTCC). The antenna 2 is reeled and is embed in a front end of the casing 5 and is arranged at the first side of the electrical connection part 11. The male connector assembly further comprises a conductive pin 21 electrically connected to the circuit board 4.

An electronic product 40 transmits a signal through an antenna unit 601 of a female connector 60 of the electronic product 40 to the antenna 2 after the flash drive 50 is plugged into the female connector 60 of the electronic product 40. The signal is transmitted through the male-head connector 1 to the circuit board 4 for processing. An authentication code is transmitted from a circuit or a chip 41 on the circuit board 4 through the antenna 2 to the antenna unit 601 of the female connector 60. The authentication code will be processed and verified by the electronic product 40. Data in the electronic product 40 can be transmitted to the flash drive 50 for being executed or stored if the authentication code is correct. Or data in the flash drive 50 can be transmitted to the electronic product 40 for being executed or stored. Therefore, the security of data storage and backup is improved.

Although the present invention has been described with reference to the preferred embodiment thereof, it will be understood that the invention is not limited to the details thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. A male connector assembly connected to a female connector, the male connector assembly comprising:

a male-head connector comprising an electrical connection part and a covering body, the covering body arranged at a first side of the electrical connection part; and an antenna arranged inside the covering body, wherein the male connector assembly is connected to the female connector; the female connector transmits a wireless signal to the antenna; the antenna transmits a back-pass signal to the female connector after the antenna receives the wireless signal; data is transmitted between the male connector assembly and the female connector when the back-pass signal is verified correctly by an electronic product electrically connected to the female connector;

wherein the electrical connection part is a universal serial bus (USB) connector, a mini USB connector, a micro USB connector, a high definition multimedia interface (HDMI) connector, a displayport connector, an RJ-45 connector or a 3.5 millimeter earphone probe;

wherein the covering body is made of plastic or rubber and comprises an absorber.

2. The male connector assembly in claim 1, wherein the absorber is made of ferrite or steel with high magnetic permeability.

3. The male connector assembly in claim 2, wherein the antenna is made of metal conductor or low temperature co-fired ceramic; the antenna is reeled and is embed in a front end of the covering body and is arranged at the first side of the electrical connection part.

4. The male connector assembly in claim 3, further comprising a conductive pin extended from the antenna, the conductive pin covered by the covering body.

5. The male connector assembly in claim 4, further comprising a lead wire, wherein a plurality of core wires of the lead wire are electrically connected to a plurality of conductive terminals of the electrical connection part and the conductive pin to form a cable line carrying signals after one side of the lead wire is through the covering body.

6. The male connector assembly in claim 5, wherein the female connector comprises an antenna unit.

7. A male connector assembly connected to a female connector, the male connector assembly comprising:

a male-head connector comprising an electrical connection part and a covering body, the covering body arranged at a first side of the electrical connection part;

a circuit board electrically connected to the electrical connection part;

a casing packing the circuit board and one part of the electrical connection part; and an antenna arranged inside the covering body and electrically connected to the circuit board, wherein the male connector assembly is connected to the female connector; the female connector transmits a wireless signal to the antenna; the antenna transmits a back-pass signal to the female connector after the antenna receives the wireless signal; data is transmitted between the male connector assembly and the female connector when the back-pass signal is verified correctly by an electronic product electrically connected to the female conductor;

wherein the electrical connection part is a universal serial bus (USB) connector, a mini USB connector, a micro USB connector, a high definition multimedia interface (HDMI) connector, a displayport connector, an RJ-45 connector or a 3.5 millimeter earphone probe;

wherein the casing is made of plastic or rubber and comprises an absorber.

8. The male connector assembly in claim 7, wherein the absorber is made of ferrite or steel with high magnetic permeability.

9. The male connector assembly in claim 8, wherein the antenna is made of metal conductor or low temperature co-fired ceramic; the antenna is reeled and is embed in a front end of the covering body and is arranged at the first side of the electrical connection part.

10. The male connector assembly in claim 9, further comprising a conductive pin extended from the antenna, the conductive pin electrically connected to the circuit board.

11. The male connector assembly in claim 10, wherein the female connector comprises an antenna unit.

* * * * *